US011807348B2

(12) United States Patent
Yv et al.

(10) Patent No.: US 11,807,348 B2
(45) Date of Patent: Nov. 7, 2023

(54) OMNIDIRECTIONAL UNDERWATER VEHICLE

(71) Applicant: Guangdong Ocean University, Zhanjiang (CN)

(72) Inventors: Guoyan Yv, Zhanjiang (CN); Zejia Chen, Jieyang (CN); Jinping Su, Chaozhou (CN); Qibo Chen, Shaoguan (CN); Shuaixing Chen, Qinzhou (CN); Zile Chen, Foshan (CN); Zhuoheng Li, Zhaoqing (CN)

(73) Assignee: GUANGDONG OCEAN UNIVERSITY, Zhanjiang (CN)

( * ) Notice: Subject to any disclaimer, the term of this patent is extended or adjusted under 35 U.S.C. 154(b) by 0 days.

(21) Appl. No.: 18/320,626

(22) Filed: May 19, 2023

(65) Prior Publication Data

US 2023/0286627 A1 Sep. 14, 2023

Related U.S. Application Data

(63) Continuation of application No. PCT/CN2022/125814, filed on Oct. 18, 2022.

(30) Foreign Application Priority Data

Oct. 20, 2021 (CN) ..... 202111220628.9

(51) Int. Cl.
*B63G 8/00* (2006.01)
*B63G 8/08* (2006.01)
*B63G 8/20* (2006.01)

(52) U.S. Cl.
CPC ..... *B63G 8/001* (2013.01); *B63G 8/08* (2013.01); *B63G 8/20* (2013.01)

(58) Field of Classification Search
CPC ..... B63G 8/001; B63G 8/08; B63G 8/20
See application file for complete search history.

(56) References Cited

U.S. PATENT DOCUMENTS 5,097,780 A * 3/1992 Winchester ..... B63G 8/16 114/330
11,091,238 B2 * 8/2021 Gao ..... B62D 57/032

FOREIGN PATENT DOCUMENTS

CN 202429337 U 9/2012
CN 106976536 A 7/2017
WO 2020144501 A1 7/2020

OTHER PUBLICATIONS

Liao Huali et al., "Design of a Disc-Shaped Four-Thruster Omnidirectional Underwater Vehicle", Mechanical manufacturing, 2008, pp. 16-19, vol. 46, No. 526.

(Continued)

*Primary Examiner* — Anthony D Wiest
(74) *Attorney, Agent, or Firm* — Zhigang Ma

(57) ABSTRACT

An omnidirectional underwater vehicle includes an open-frame mechanism including a frame with top thrusters at four corners of a top end of the frame; mechanical arms disposed at a front end of the frame; and a rotary holder disposed in the frame and including a motor fixing plate, an upper bearing fixing plate and a lower bearing fixing plate. A cylindrical roller bearing is fixed between the upper bearing fixing plate and the lower bearing fixing plate, and an inner edge of the cylindrical roller bearing is provided with two bearing clip inner plates from top to bottom. A servo motor is fixed on the motor fixing plate, a bottom end of the bearing clip inner plate at the bottom is fixedly connected to a steering gear fixing plate, and a top end of the steering gear fixing plate is provided with fully waterproof steering gears installed with underwater thrusters.

9 Claims, 4 Drawing Sheets

(56) References Cited

OTHER PUBLICATIONS

CNIPA, Notification of a First Office Action for CN202111220628.9, dated Feb. 23, 2022.
Guangdong ocean university (Applicant), Reply to Notification of a First Office Action for CN202111220628.9, dated Mar. 15, 2022.
Guangdong ocean university (Applicant), Supplemental Reply to Notification of a First Office Action for CN202111220628.9, w/(allowed) replacement claims, dated Mar. 28, 2022.
CNIPA, Notification to grant patent right for invention in CN202111220628.9, dated Apr. 6, 2022.

* cited by examiner

OMNIDIRECTIONAL UNDERWATER VEHICLE

TECHNICAL FIELD

The disclosure relates to the field of marine engineering and submarine resource development technologies, and more particularly to an omnidirectional underwater vehicle.

BACKGROUND

Marine engineering refers to new construction, reconstruction, and expansion projects aimed at developing, utilizing, protecting, and restoring marine resources, with the main body of the project located on the seaward side of the coastline. It is generally believed that the main content of marine engineering can be divided into two parts including resource development technology and equipment and facilities technology, specifically including: coastal reclamation, offshore dam engineering, artificial islands, offshore and submarine material storage facilities, cross-sea bridge engineering, submarine tunnel engineering, submarine pipeline engineering, submarine power (optical) cable engineering, exploration and development of marine mineral resources and its ancillary projects, marine energy development and utilization projects such as offshore tidal power plants, wave power plants and thermal power plants, large-scale marine aquaculture farms, artificial reef projects, seawater comprehensive utilization engineering such as such as salt fields and seawater desalination, marine entertainment, sports and landscape development engineering, and other marine engineering specified by the national marine authorities in conjunction with the environmental protection authorities.

Limited by the harsh environment of the seabed, large-scale deep-sea ocean engineering mainly relies on underwater vehicles to perform work. However, traditional open-frame underwater vehicles are mainly used for the observation function, while underwater thrusters of most of work-level underwater vehicles currently are fixed on the frame of the vehicle itself, and thus the thrusters cannot be fully and effectively utilized, which not only reduces the working efficiency of the thrusters and consumes large amounts of energy, but also limits the flexibility of the vehicle, and cannot adjust an optimal direction of the thrusters based on the direction of submarine ocean current, thereby seriously restricting the sustainable development of marine engineering and damaging the safety of underwater vehicles.

In view of the current waste of electrical energy and economic losses caused by fixed thrusters, after in-depth investigation and study of relevant papers and patents, there is only a paper published by the College of Mechanical and Electrical Engineering of Hohai University on the design of omnidirectional underwater vehicles in China, "Design of a Disc-Shaped Four-Thruster Omnidirectional Underwater Vehicle". However, due to its low degree of freedom, it only exists in theory, and there are a series of difficult control problem, which cannot be widely applied to industrial technology. Therefore, a new type of omnidirectional underwater vehicle is urgently needed to solve technical problems of the traditional open-frame underwater vehicle with high energy consumption, low degrees of freedom, poor flexibility, and low intelligence level.

SUMMARY

An objective of the disclosure is to provide an omnidirectional underwater vehicle to solve the problems existing in the aforementioned prior art, overcome the disadvantages of high energy consumption and low degrees of freedom of traditional work-level underwater vehicles, improve the traveling efficiency, safety, and the intelligent level of the underwater vehicle.

To achieve the above objective, the disclosure provides the following solution. The disclosure provides an omnidirectional underwater vehicle, including: an open-frame mechanism including a frame, mechanical arms, and a rotary holder. Top thrusters are arranged at four corners of a top end of the frame. The mechanical arms are disposed at a front end of the frame. The rotary holder is disposed in the frame and includes a motor fixing plate, an upper bearing fixing plate, and a lower bearing fixing plate sequentially and fixedly connected in that order from top to bottom. A cylindrical roller bearing is fixed between the upper bearing fixing plate and the lower bearing fixing plate, an inner edge of the cylindrical roller bearing is sequentially provided with two bearing clip inner plates from top to bottom, the two bearing clip inner plates are fixedly connected, and outer edges of the two bearing clip inner plates are in interference fit with the inner edge of the cylindrical roller bearing. A servo motor is fixed on the motor fixing plate, and the bearing clip inner plate at the top is fixedly connected to an output shaft of the servo motor. A bottom end of the bearing clip inner plate at the bottom is fixedly connected to a steering gear fixing plate, a top end of the steering gear fixing plate is provided with a plurality of fully waterproof steering gears, the plurality of fully waterproof steering gears are provided with underwater thrusters, and the underwater thrusters are uniformly distributed at a bottom end of the steering gear fixing plate.

In an embodiment, an upper aluminum alloy plate and a lower aluminum alloy plate are respectively fixed at an upper end and a lower end of the frame, and the frame includes a plurality of aluminum profiles fixed between the upper aluminum alloy plate and the lower aluminum alloy plate, and the plurality of aluminum profiles are fixedly connected through connecting corner braces.

In an embodiment, the top thrusters are fixedly installed at four corners of a top end of the upper aluminum alloy plate.

In an embodiment, the motor fixing plate is fixed with the upper aluminum alloy plate through several hexagonal bolts.

In an embodiment, the motor fixing plate and the upper bearing fixing plate, the upper bearing fixing plate and the lower bearing fixing plate are respectively fixed by several hexagonal bolts, and the two bearing clip inner plates are fixed by several copper posts.

In an embodiment, the servo motor is fixedly connected to the motor fixing plate through a motor reinforcing pad, and the output shaft of the servo motor is fixedly connected to the bearing clip inner plate through a connecting flange.

In an embodiment, the steering gear fixing plate is fixedly connected to the bearing clip inner plate through several copper posts, the fully waterproof steering gear is fixed with a thruster clamp through a connecting flange, and the underwater thruster is installed in the thruster clamp.

In an embodiment, the number of underwater thrusters is four, and the four underwater thrusters are uniformly distributed around a bottom surface of the steering gear fixing plate.

In an embodiment, bottom ends of the underwater thrusters are provided with several pressure proof tanks disposed sequentially spaced from each other. The pressure proof tanks are located at a top of the lower aluminum alloy plate, and the pressure proof tanks are fixed on the frame. The pressure proof tank is equipped with a high-definition camera and a control circuit board.

In an embodiment, the front end of the frame is fixed with several underwater searchlights.

The disclosure discloses the following technical effects. Compared with existing work-level underwater vehicles, the omnidirectional underwater vehicle provided by the disclosure has high realizability, safe and reliable operation, high portability, strong loadability, simple structure, and can provide reliable performance improvements and achieve the effects of energy conservation and emission reduction. Its underwater thruster can rotate around its own axis, which can provide the best driving force in the direction of travel and effectively compensate for current and cable resistance.

BRIEF DESCRIPTION OF DRAWINGS

In order to illustrate embodiments of the disclosure or the technical solutions in the related art more clearly, a brief introduction will be made to the drawings needed in the embodiments below. Apparently, the drawings described below are only some embodiments of the disclosure. For those skilled in the art, other drawings can be obtained from these drawings without any creative effort.

DESCRIPTION OF REFERENCE NUMERALS

Figure 1:
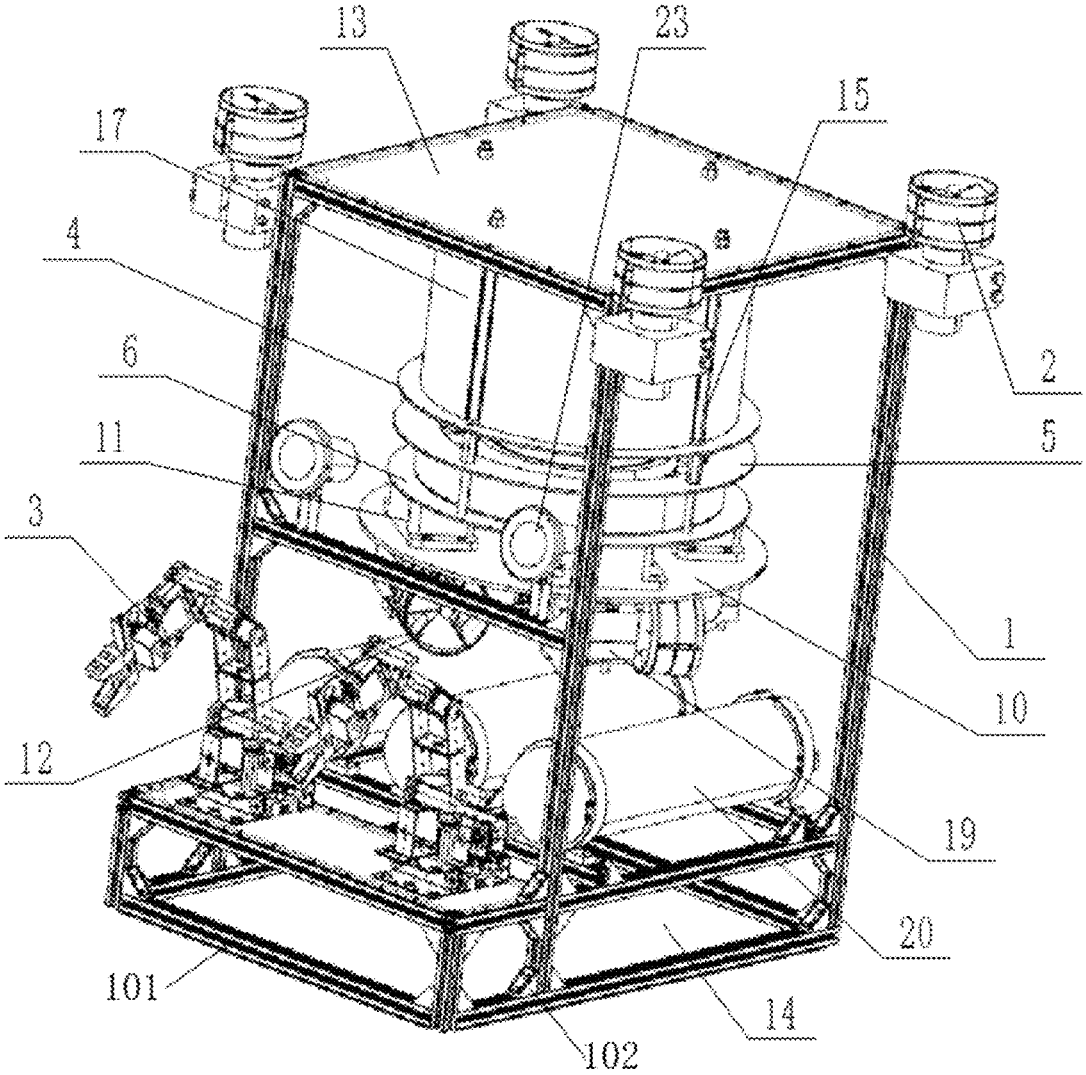
FIG. 1 illustrates a schematic structural diagram of an omnidirectional underwater vehicle of the disclosure.
Figure 2:
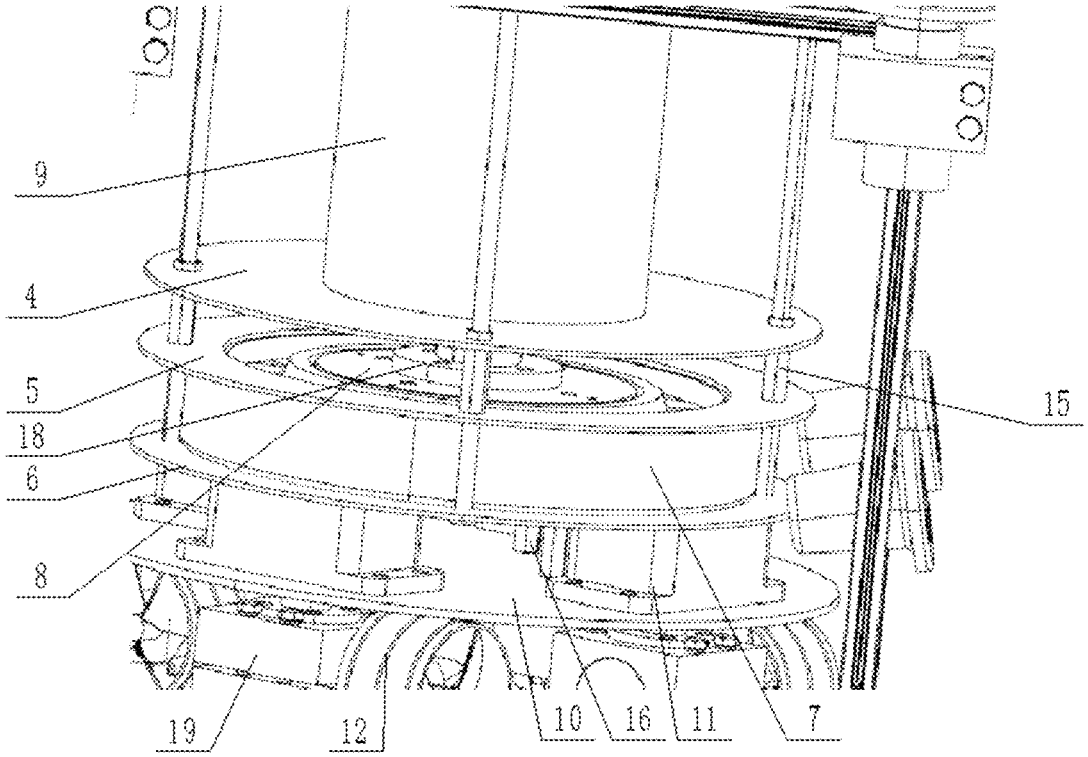
FIG. 2 illustrates a schematic structural diagram showing a rotary holder of the disclosure.
Figure 3:
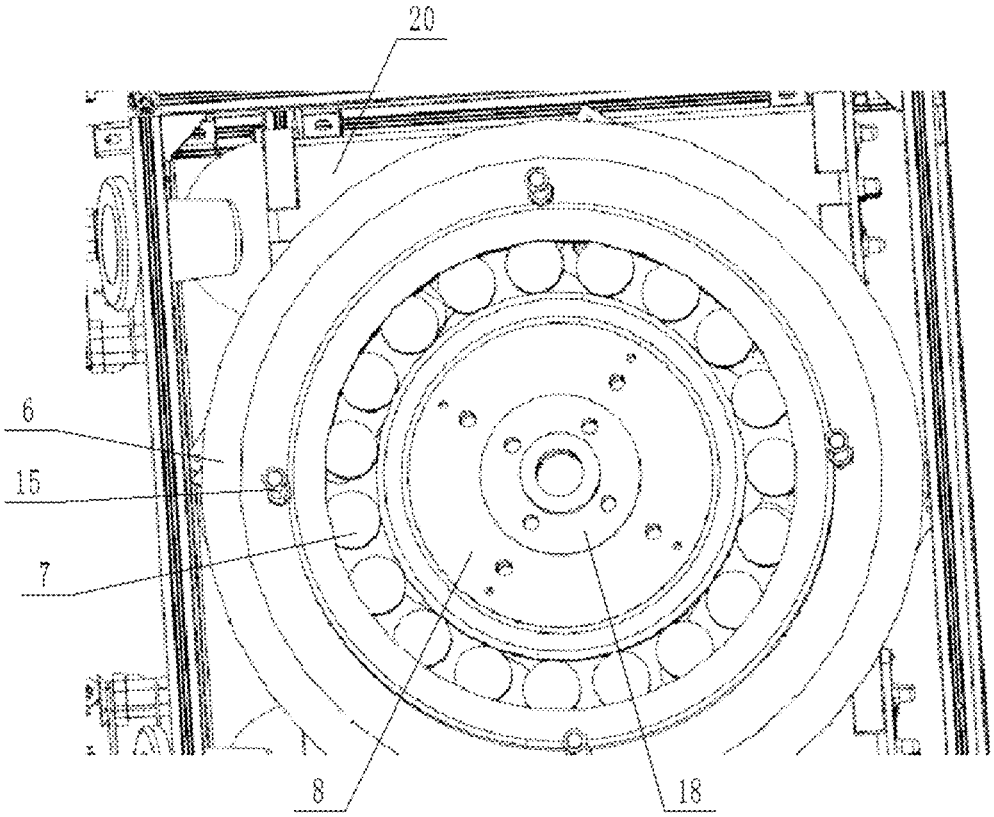
FIG. 3 illustrates a schematic structural diagram showing a cylindrical roller bearing of the disclosure.
Figure 4:
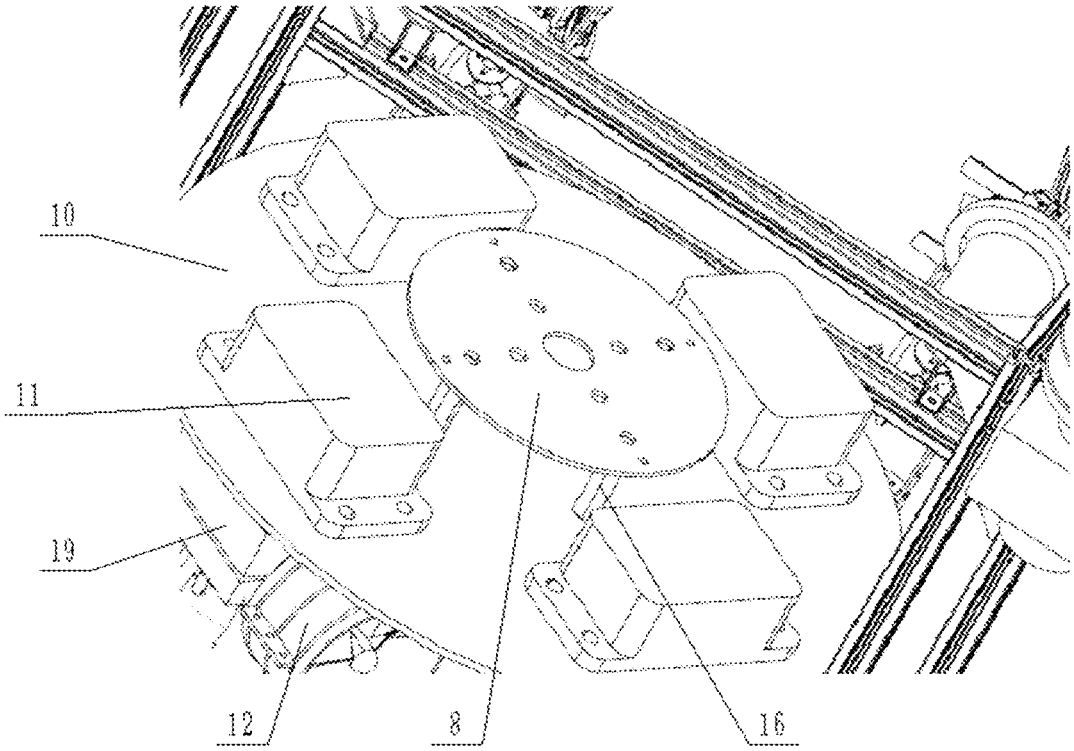
FIG. 4 illustrates a schematic structural diagram showing a steering gear fixing plate of the disclosure.
Figure 5:
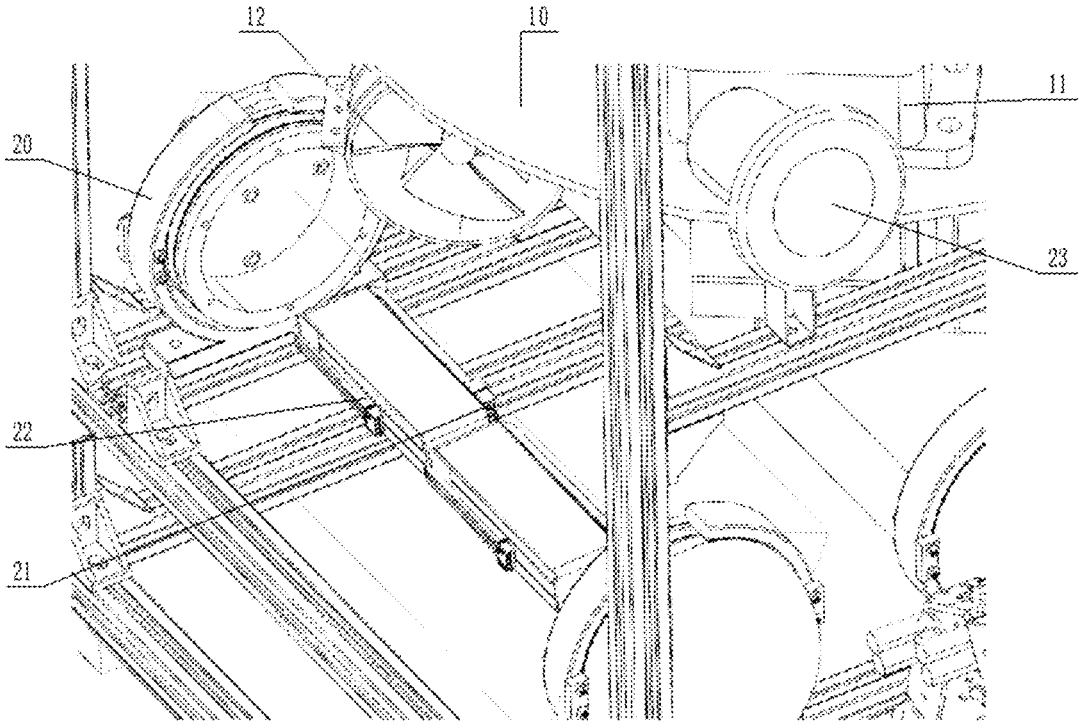
FIG. 5 illustrates a schematic structural diagram showing a pressure proof tank of the disclosure.

1: frame, 101: aluminum profile, 102: connecting corner brace, 2: top thruster, 3: mechanical arm, 4: motor fixing plate, 5: upper bearing fixing plate, 6: lower bearing fixing plate, 7: cylindrical roller bearing, 8: bearing clip inner plate, 9: servo motor, 10: steering gear fixing plate, 11: fully waterproof steering gear, 12: underwater thruster, 13: upper aluminum alloy plate, 14: lower aluminum alloy plate, 15: hexagonal bolt, 16: copper post, 17: motor reinforcing pad, 18: connecting flange, 19: thruster clamp, 20: pressure proof tank, 21: high-definition camera, 22: control circuit board, and 23: underwater searchlight.

DETAILED DESCRIPTION OF EMBODIMENTS

In the following, the technical solutions in embodiments of the disclosure will be clearly and completely described in conjunction with the accompanying drawings. Apparently, the described embodiments are only a part of the embodiments of the disclosure, not all of them. Based on the embodiments in the disclosure, all other embodiments obtained by those skilled in the art without creative work fall within the scope of protection of the disclosure.

In order to make the objectives, features, and advantages of the disclosure more apparent and understandable, a further detailed description of the disclosure is provided below in conjunction with the accompanying drawings and specific embodiments.

Referring to FIGS. 1-5, the disclosure is applied to the fields of marine engineering and submarine resource development technologies. After in-depth research on relevant art, in order to address the shortcomings of high energy consumption, low degrees of freedom, poor flexibility, and low intelligence of traditional open-frame underwater vehicles, an omnidirectional underwater vehicle is proposed to solve the problems of high energy consumption and low degrees of freedom of work-level underwater vehicles and improve the traveling efficiency, safety and the intelligent level of the underwater vehicle. Specifically, the omnidirectional underwater vehicle includes: an open-frame mechanism including a frame 1 with top thrusters 2 at four corners of a top of the frame 1, mechanical arms 3, and a rotary holder (also referred to rotating platform). The mechanical arms 3 are disposed at a front end of the frame 1, the front end of the frame 1 is provided with a mechanical arm fixing plate, and the mechanical arms 3 are fixed on the mechanical arm fixing plate. The mechanical arm 3 mainly consists of a fully waterproof steering gear 11 and U-shaped connectors (not shown in the figure). The rotary holder is disposed in the frame 1. The rotary holder includes a motor fixing plate 4, an upper bearing fixing plate 5, and a lower bearing fixing plate 6 sequentially and fixedly connected in that order from top to bottom. A cylindrical roller bearing 7 is fixed between the upper bearing fixing plate 5 and the lower bearing fixing plate 6, an inner edge of the cylindrical roller bearing 7 is sequentially provided with two bearing clip inner plates 8 from top to bottom, the two bearing clip inner plates 8 are fixedly connected, and outer edges of the bearing clip inner plates 8 are in interference fit with the inner edge of the cylindrical roller bearing 7. The motor fixing plate 4, the upper bearing fixing plate 5, and the lower bearing fixing plate 6 of the rotary holder are connected through four hexagonal bolts 15 thereby establishing the basic structure of the rotary holder, and then the cylindrical roller bearing 7 is fixed between the upper bearing fixing plate 5 and the lower bearing fixing plate 6. The upper and lower bearing clip inner plates 8 are fixedly connected through four copper posts 16 and are in interference fit with the cylindrical roller bearing 7 to form a hollow rotating platform. The motor fixing plate 4 is fixed with a servo motor 9, the bearing clip inner plate 8 at the top is fixedly connected to an output shaft of the servo motor 9, and a bottom end of the bearing clip inner plate 8 at the bottom is fixedly connected to a steering gear fixing plate 10. A top end of the steering gear fixing plate 10 is provided with a number of fully waterproof steering gears 11, the fully waterproof steering gears 11 are equipped with underwater thrusters 12, and the underwater thrusters 12 are uniformly distributed at a bottom end of the steering gear fixing plate 10. In this embodiment, the number of underwater thrusters 12 is preferably four. One-stage rotation of the hollow rotating platform is realized through the driving of the servo motor 9, so that the arrangement direction of the four underwater thrusters 12 can be completely controlled only by the servo motor 9. The steering gear fixing plate 10 is fixedly connected to the bearing clip inner plate 8 through four copper columns 16 and fixedly installed with four fully waterproof steering gears 11, the four fully waterproof steering gears 11 are each fixed to the thruster clamp 19 through a connecting flange, so that the four underwater thrusters 12 can be placed at any angle to form a two-stage rotation. When the vehicle encounters an impact of ocean currents underwater, the vehicle can sense the vehicle's balance state in real time through the MPU6050™ posture sensor and upload the state information to the host machine. After processing the state information, the host machine transmits parameter information such as one-stage or two-stage rotation, and rotation angle of the underwater thruster 12 to the underwater vehicle through a cable, thereby controlling the arrangement directions and angles of the underwater thrusters 12, and effectively reducing the influence caused by the impact of ocean current.

In an embodiment, an upper aluminum alloy plate 13 and a lower aluminum alloy plate 14 are respectively fixed at an upper end and a lower end of the frame 1. The frame 1 includes a number of aluminum profiles 101 fixed between the upper aluminum alloy plate 13 and the lower aluminum alloy plate 14, the aluminum profiles 101 are fixedly connected through connecting corner braces 102, and a number of top thrusters 2 are fixedly installed at four corners of a top of the upper aluminum alloy plate 13. In this embodiment, the number of top thrusters 2 is preferably four. The open-frame mechanism connects the aluminum profiles 101 through the connecting corner braces 102 to build the overall frame structure of the vehicle. The strength and stiffness of the overall frame structure of the fixed vehicle are strengthened through two upper and lower aluminum alloy plates 13 and 14. The vehicle's ascent and descent functions are realized by fixing four top thrusters 2 above.

In an embodiment, the motor fixing plate 4 is fixed to the upper aluminum alloy plate 13 through a number of hexagonal bolts 15 to achieve the fixation between the rotary holder and the open-frame mechanism.

In an embodiment, the motor fixing plate 4 and the upper bearing fixing plate 5, the upper bearing fixing plate 5 and the lower bearing fixing plate 6 are respectively fixed by a number of hexagonal bolts 15 to form a hollow basic frame of the rotary holder. The two bearing clip inner plates 8 are fixed by a number of copper posts 16, enabling the servo motor 9 to synchronously drive the two bearing clip inner plates 8 to rotate.

In an embodiment, the servo motor 9 is fixedly connected to the motor fixing plate 4 through the motor reinforcing pad 17, the output shaft of the servo motor 9 is fixedly connected to the bearing clip inner plate 8 through the connecting flange 18, the servo motor 9 on the top is fixedly connected to the rotating platform through the motor reinforcing pad 17, and the rotating shaft of the servo motor 9 is fixedly connected to the bearing clip inner plate 8 through the connecting flange 18, achieving the one-stage rotation of the hollow rotating platform through the drive of the servo motor 9, so that the arrangement directions of the four underwater thrusters 12 can be completely controlled only by the servo motor 9.

In an embodiment, the steering gear fixing plate 10 is fixedly connected to the bearing clip inner plate 8 through a number of copper posts 16, the fully waterproof steering gear 11 is fixed with the thruster clamp 19 through the connecting flange 18, and the underwater thruster 12 is installed in the thruster clamp 19, realizing the arbitrary angle placement of the four underwater thrusters 12, forming the second-stage rotation.

In an embodiment, the number of underwater thrusters 12 is four, and the four underwater thrusters 12 are uniformly distributed around the bottom surface of the steering gear fixing plate 10.

In an embodiment, the bottom end of the underwater thrusters 12 are provided with a number of pressure proof tanks 20 sequentially spaced from each other. The pressure proof tanks 20 are located on the top of the lower aluminum alloy plate 14 and fixed on the frame 1. The pressure proof tank 20 is equipped with a high-definition camera 21 and a control circuit board 22, and electronic control components such as the underwater high-definition camera 21 and the control circuit board 22 are stored in the pressure proof tank 20.

In an embodiment, a number of underwater searchlights 23 are fixed at the front end of the frame 1, and the underwater searchlights 23 are used for providing illumination for the vehicle underwater.

Figure 6:
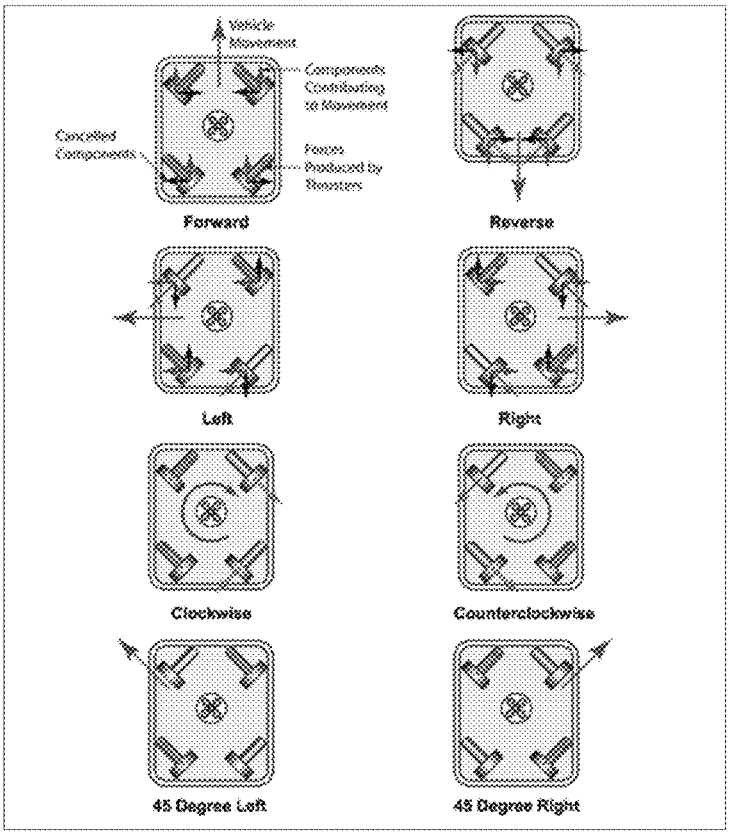
FIG. 6 illustrates positions and force states of underwater thrusters in an embodiment of the disclosure.

In terms of energy saving, no matter how the thrusters are placed, there will always be component forces that offset each other, which reduces the power of the thrusters and causes a certain amount of useless work. Referring to FIG. 6, the omnidirectional underwater vehicle of the disclosure can provide the best driving force in the direction of travel according to the requirements, and the driving force provided by the omnidirectional underwater vehicle is also far greater than that of the traditional underwater vehicle.

Figure 7:
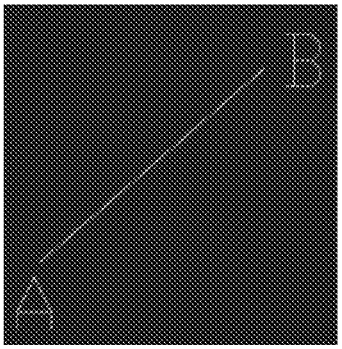
FIG. 7 illustrates a path of a traditional underwater vehicle and the omnidirectional underwater vehicle in the embodiment of the disclosure.

Referring to FIG. 7, from point A to point B, the traditional underwater vehicle needs to make a bow turn before driving forward in a straight line, while the omnidirectional underwater vehicle of the disclosure only needs to rotate a certain angle through the servo motor 9 and then directly moves forward in a straight line.

Work done by the traditional underwater vehicle is expressed as: W1=Wbow+F (thruster axial force)*L (displacement between two points A and B).

Work done by the omnidirectional underwater vehicle of the disclosure is expressed as: W2=Wpower (for driving servo motor 7)+F (axial force of underwater thruster 12)*L (displacement between two points A and B).

Due to the fact that the Wbow is much larger than the Wpower, W1 is much larger than W2. With the same displacement, it is clear that the omnidirectional underwater vehicle of the disclosure consumes less electrical energy and has higher work efficiency.

In terms of flexibility, from point A to point B, the traditional underwater vehicle needs to undergo a bow turning process to reach the point B in a straight line, while the omnidirectional underwater vehicle of the disclosure can directly change the direction of the underwater thrusters 12 through the fully waterproof steering gears 11 or the servo motor 9, thereby directly driving the underwater thrusters 12 to reach the point B.

Compared with existing work-level underwater vehicles, the omnidirectional underwater vehicle provided by the disclosure has high realizability, safe and reliable operation, high portability, strong loadability, simple structure, and can provide reliable performance improvements and achieve the effect of energy conservation and emission reduction. Its underwater thrusters 12 can rotate around its own axis, which can provide the best driving force in the direction of travel and effectively compensate for current and cable resistance.

In the description of the disclosure, it is necessary to understand that the terms "longitudinal", "transverse", "up", "down", "front", "back", "left", "right", "vertical", "horizontal", "top", "bottom", "inside", "outside", and the like indicate orientation or positional relationships based on the orientation or positional relationships shown in the accompanying drawings and are intended only to facilitate the description of the invention, not to indicate or imply that the device or element referred to must have a particular orientation or be constructed and operate in a particular orientation, and therefore are not to be construed as limiting the disclosure.

The above-described embodiments are only a description of the illustrated method of the disclosure, not a limitation of the scope of the disclosure. Without departing from the spirit of the design of the disclosure, various modifications and changes made by those skilled in the art to the technical solution of the disclosure shall fall within the scope of protection determined by the claims of the disclosure.

What is claimed is:

1. An omnidirectional underwater vehicle, comprising:

an open-frame mechanism, comprising a frame (1), wherein top thrusters (2) are arranged at four corners of a top end of the frame (1) respectively;

mechanical arms (3), disposed at a front end of the frame (1);

a rotary holder, disposed in the frame (1), comprising a motor fixing plate (4), an upper bearing fixing plate (5) and a lower bearing fixing plate (6) sequentially and fixedly connected in that order from top to bottom; wherein a cylindrical roller bearing (7) is fixed between the upper bearing fixing plate (5) and the lower bearing fixing plate (6), an inner edge of the cylindrical roller bearing (7) is sequentially disposed with two bearing clip inner plates (8) from top to bottom, the two bearing clip inner plates (8) are fixedly connected, and outer edges of the two bearing clip inner plates (8) are in interference fit with the inner edge of the cylindrical roller bearing (7); a servo motor (9) is fixed on the motor fixing plate (4), and the bearing clip inner plate (8) at the top is fixedly connected to an output shaft of the servo motor (9); a bottom end of the bearing clip inner plate (8) at the bottom is fixedly connected to a steering gear fixing plate (10), a top end of the steering gear fixing plate (10) is provided with a plurality of waterproof steering gears (11), the plurality of waterproof steering gears (11) are provided with underwater thrusters (12), and the underwater thrusters (12) are uniformly distributed at a bottom end of the steering gear fixing plate (10);

wherein the motor fixing plate (4) and the upper bearing fixing plate (5), the upper bearing fixing plate (5) and the lower bearing fixing plate (6) are respectively fixed by a plurality of hexagonal bolts (15), and the two bearing clip inner plates (8) are fixed by a plurality of copper posts (16).

2. The omnidirectional underwater vehicle according to claim 1, wherein an upper aluminum alloy plate (13) and a lower aluminum alloy plate (14) are respectively fixed at an upper end and a lower end of the frame (1), and the frame (1) comprises a plurality of aluminum profiles (101) fixed between the upper aluminum alloy plate (13) and the lower aluminum alloy plate (14), and the plurality of aluminum profiles (101) are fixedly connected through connecting corner braces (102).

3. The omnidirectional underwater vehicle according to claim 2, wherein the top thrusters (2) are fixedly installed at four corners of a top end of the upper aluminum alloy plate (13).

4. The omnidirectional underwater vehicle according to claim 2, wherein the motor fixing plate (4) is fixed with the upper aluminum alloy plate (13) through a plurality of hexagonal bolts (15).

5. The omnidirectional underwater vehicle according to claim 2, wherein bottom ends of the underwater thrusters (12) are disposed with a plurality of pressure proof tanks (20) sequentially spaced from each other, the plurality of pressure proof tanks (20) are located at a top of the lower aluminum alloy plate (14), the plurality of pressure proof tanks (20) are fixed on the frame (1), and a camera (21) and a control circuit board (22) are placed in the pressure proof tank (20).

6. The omnidirectional underwater vehicle according to claim 1, wherein the servo motor (9) is fixedly connected to the motor fixing plate (4) through a motor reinforcing pad (17), and the output shaft of the servo motor (9) is fixedly connected to the bearing clip inner plate (8) through a connecting flange (18).

7. The omnidirectional underwater vehicle according to claim 1, wherein the steering gear fixing plate (10) is fixedly connected to the bearing clip inner plate (8) through a plurality of copper posts (16), the waterproof steering gear (11) is fixed with a thruster clamp (19) through a connecting flange (18), and the underwater thruster (12) is installed in the thruster clamp (19).

8. The omnidirectional underwater vehicle according to claim 1, wherein a number of the underwater thrusters (12) is four, and the four underwater thrusters (12) are uniformly distributed around a bottom surface of the steering gear fixing plate (10).

9. The omnidirectional underwater vehicle according to claim 1, wherein a plurality of underwater searchlights (23) are fixed at the front end of the frame (1).

* * * * *